US009487902B2

(12) United States Patent
Schulze

(10) Patent No.: US 9,487,902 B2
(45) Date of Patent: Nov. 8, 2016

(54) WASHING MACHINE HAVING A DEVICE FOR PRODUCING WATER DROPS AND METHOD FOR OPERATING SAID WASHING MACHINE

(71) Applicant: BSH BOSCH UND SIEMENS HAUSGERÄTE GmbH, München (DE)

(72) Inventor: Ingo Schulze, Panketal (DE)

(73) Assignee: BSH HAUSGERÄTE GMBH, Munich (DE)

( * ) Notice: Subject to any disclaimer, the term of this patent is extended or adjusted under 35 U.S.C. 154(b) by 0 days.

(21) Appl. No.: 14/419,983

(22) PCT Filed: Jul. 25, 2013

(86) PCT No.: PCT/EP2013/065728
§ 371 (c)(1),
(2) Date: Feb. 6, 2015

(87) PCT Pub. No.: WO2014/023579
PCT Pub. Date: Feb. 13, 2014

(65) Prior Publication Data

US 2015/0225887 A1 Aug. 13, 2015

(30) Foreign Application Priority Data

Aug. 7, 2012 (DE) ..... 10 2012 213 934

(51) Int. Cl.
*D06F 35/00* (2006.01)
*D06F 39/00* (2006.01)
*D06F 39/08* (2006.01)

(52) U.S. Cl.
CPC ..... *D06F 39/008* (2013.01); *D06F 35/00* (2013.01); *D06F 39/087* (2013.01); *D06F 39/088* (2013.01)

(58) Field of Classification Search
CPC .... D06F 35/00; D06F 39/008; D06F 39/087; D06F 39/088
USPC ..... 8/158, 159; 68/3 R, 200, 207
See application file for complete search history.

(56) References Cited

U.S. PATENT DOCUMENTS

2005/0268668 A1 12/2005 Miyauti et al.
2007/0028398 A1* 2/2007 Kwon ..... D06F 25/00 8/158

(Continued)

FOREIGN PATENT DOCUMENTS

CN 1818195 A 8/2006
CN 101381938 A 3/2009

(Continued)

OTHER PUBLICATIONS

International Search Report for PCT/EP2013/065728 mailed Oct. 18, 2013, 3 pages.
Written Opinion of the International Searching Authority for PCT/EP2013/065728, mailed Oct. 18, 2013, 5 pages.
International Preliminary Report for Patentability with Amended Sheets, dated Aug. 14, 2014, for PCT/EP2013/065728, 21 pages.

*Primary Examiner* — Michael Barr
*Assistant Examiner* — Levon J Shahinian
(74) *Attorney, Agent, or Firm* — Nixon & Vanderhye P.C.

(57) ABSTRACT

The invention relates to a washing machine (1) having a drum (2) for accommodating laundry items (7) to be treated, which drum is rotatably supported in a suds container (3). The washing machine comprises a water supply system (8, 10), a control apparatus (12), a water container (29), and a water-drop producer (18, 22). The water-drop producer (18, 22) has an ultrasonic nebulizer (18), which is arranged in the water container (29). The invention further relates to a method for treating laundry items (7) in said washing machine.

12 Claims, 2 Drawing Sheets

(56) References Cited

U.S. PATENT DOCUMENTS

Figure 1:
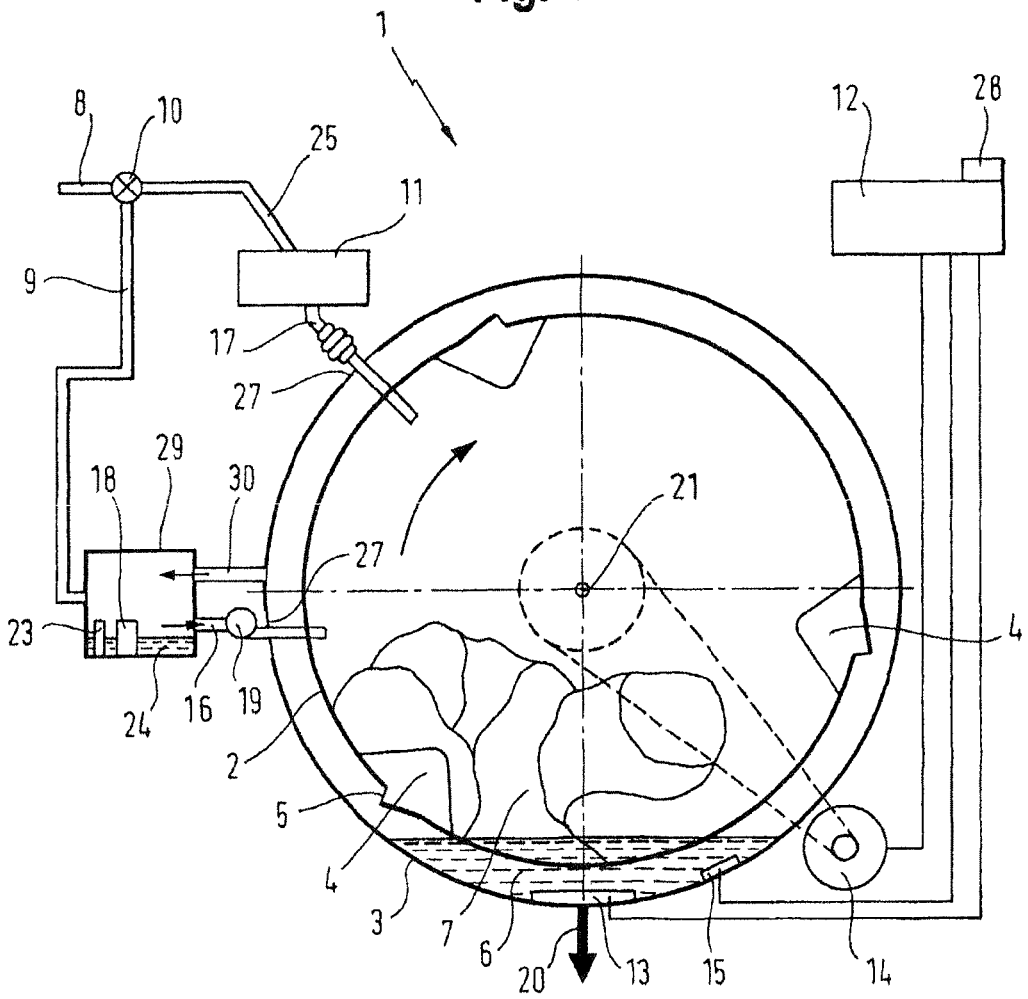

| | | | | |
|---|---|---|---|---|
| 2009/0095032 | A1 | 4/2009 | Lee | |
| 2010/0139334 | A1* | 6/2010 | Kim | D06F 58/203 68/5 C |

FOREIGN PATENT DOCUMENTS

| | | |
|---|---|---|
| DE | 10 2008 050690 | 4/2009 |
| EP | 0 487 474 | 5/1992 |

* cited by examiner

WASHING MACHINE HAVING A DEVICE FOR PRODUCING WATER DROPS AND METHOD FOR OPERATING SAID WASHING MACHINE

This application is the U.S. national phase of International Application No. PCT/EP2013/065728, filed 25 Jul. 2013, which designated the U.S. and claims priority to DE 10 2012 213 934.6, filed 7 Aug. 2012, the entire contents of each of which are hereby incorporated by reference.

The invention relates to a washing machine having a device for producing water drops and a method for operating said washing machine. The invention relates in particular to a washing machine having a drum for accommodating laundry items to be treated, which is supported in a rotatable manner in an outer tub, comprising a water supply system, a control apparatus, a water container and a device for producing water drops (also referred to in the following as a water drop producer).

The question generally asked of washing methods in a washing machine is how such washing methods can be made even more efficient, preferably reducing water consumption even further without having an adverse effect on the cleaning action, e.g. a degree of cleaning of laundry items that can be achieved by washing.

In a washing method laundry items are generally initially placed in a drum of a washing machine. A water/washing agent mixture is then generally flushed in and a mechanical washing action, in other words mechanical energy, is introduced by way of horizontally or vertically rotating drums, with the laundry also dropping down in particular in the process. Finally thermal energy is generally introduced in that the wash liquor and/or laundry items are heated by way of a heating element generally arranged in the outer tub. The loosened and detached dirt is then generally flushed out during one or more rinse cycles. This latter can be assisted by a previous pumping away and spinning off of the water and the dirt it contains. The damp laundry items are then centrifuged and/or dried thermally.

Methods are also known in which textiles are soaked before washing to loosen dried-on dirt. Methods are also known in which a water/washing agent mixture is foamed in order to achieve more effective wetting of the surface of the laundry items and more effective dissolving of the washing agent. Finally pretreatments such as prewashes at relatively low temperatures and/or with little mechanical washing action are also known.

Such methods share the fact that during pretreatment and washing the laundry item is saturated with water. In this process some surface dirt is conducted into the interior of the fibers or laundry items and can only be removed again from the laundry item with difficulty during subsequent washing. This not only requires a great deal of time and energy; it also means that a greater mechanical washing action and more water and washing agent have to be used. The dirt is generally on the surface of a laundry item (for example particle soiling, protein soiling, grease). Penetration into deeper layers of the laundry item or deeper fiber parts is associated to some extent with becoming caught up therewith. Also capillary processes can result in deeper dirt penetration. This is particularly critical for laundry items that are more delicate and are subject to permanent shape changes and in particular shrinkage (wool, silk) or direct fiber damage if they undergo a conventional wet treatment.

Additional functions are frequently also offered in laundry treatment appliances such as tumble dryers, washing machines or washer/dryers. These include textile smoothing, crease reduction, odor elimination, e.g. by means of water vapor extraction, steam heating in addition or as an alternative to conventional heating as well as hygiene measures for both laundry care and appliance care. It is known for example from documents DE 10 2005 056 354 A1 and EP 1 275 767 A1 that laundry can be treated with steam in a washing machine before ironing.

EP 1 275 767 A1 describes a tumble dryer or automatic washing machine having a steaming device, in which steam is supplied to the laundry after water has been extracted, in that the water present in the outer tub is heated until steam is produced. The steam penetrates into the drum and comes into contact with the laundry items.

In DE 102 60 151 A1 a laundry treatment appliance is described, in which a processing unit for a liquid for producing mist or steam is connected to a process air channel so that steam can be introduced into the laundry drum as process air is supplied. This is intended to remove odorous substances from textiles. A similar method is described in DE 10 2005 046 163 A1.

A tumble dryer and the use of an ultrasonic atomizer are known from DE 102 60 156 A1.

Against this background the object of the present invention is to provide a washing machine which allows additional functions and in particular timely loosening and detaching of dirt from laundry items so that gentle cleaning in particular is also possible. It should preferably be possible to achieve this with little water. It is also the object of the invention to provide a method for treating laundry items using said washing machine, which preferably also allows delicate laundry items to be cleaned and/or water consumption to be reduced.

The object underlying the invention is achieved by a washing machine and a method for treating laundry items according to the respective independent claim. Preferred embodiments of the invention are set out in the respectively dependent claims. Preferred embodiments of the inventive method correspond to preferred embodiments of the inventive washing machine, even if this is not specifically indicated in each instance here.

The subject matter of the invention is therefore a washing machine having a drum for accommodating laundry items to be treated, which is supported in a rotatable manner in an outer tub, comprising a water supply system, a control apparatus, a water container and a water drop producer, the water drop producer having an ultrasonic nebulizer which is arranged in the water container.

Treatment here refers primarily to cleaning, disinfecting, removing creases from and refreshing laundry items as well as loosening dirt present thereon.

It is advantageously possible with the aid of an ultrasonic nebulizer to set a small drop size, for example in a range from 0.2 to 10 μm, preferably in a range from 1 to 5 μm. In a washing machine when a very fine water mist is produced, the evaporation of the mist in a laundry drum can be accelerated and any wetting of the laundry items can be avoided. This is of interest for example when the aim is to remove creases from laundry items.

The ultrasonic nebulizer is preferably a piezoelectric, preferably a piezoceramic, ultrasonic nebulizer. This type of nebulizer has the advantage that the output of the ultrasonic nebulizer can be regulated infinitely. This is particularly advantageous as the required quantity of aerosol is a function of factors such as the quantity of objects to be cleaned, e.g. soiled laundry items, that are loaded as well as the nature and quantity of soiling, and should preferably be set correspondingly.

An aerosol produced by a piezoceramic ultrasonic nebulizer generally has a homogeneous drop size distribution. This homogeneous distribution can be utilized for an even wetting or treatment of laundry items. Also the drop size can be controlled specifically when using a piezoceramic ultrasonic nebulizer.

Finally the energy requirement for atomizing an aqueous liquid is low when using such an ultrasonic nebulizer.

The ultrasonic nebulizer used in the inventive washing machine essentially produces an aerosol from an aqueous liquid. The terms "mist" and "aerosol" are used to mean the same thing here. The aqueous liquid is either water or an aqueous solution containing additives, the additives generally being embodied in such a manner that they impose certain actions on the laundry items to be treated. For example said additives can give certain properties (e.g. fragrances, colorants) to laundry items or can advantageously influence a laundry treatment process (e.g. detergents). Such additives are advantageously washing aids, such as detergents for example.

The delivery of the produced aerosol or where applicable a steam/aerosol mixture into the drum can be brought about by a separate fan or by the ultrasonic nebulizer itself. Generally delivery takes place in the upper region of the washing machine in an open and unpressurized manner, preferably by way of a sleeve.

In the washing machine the ultrasonic nebulizer is preferably connected to the drum by way of a mist channel, in which a fan is present to convey the mist produced from the water in the ultrasonic nebulizer.

In one preferred embodiment of the invention the washing machine has a heating element to produce steam. It is generally arranged outside the outer tub. The heating element, if present, is preferably a heating coil. A temperature sensor, preferably a fast NTC, is then preferably present in or on the heating element. The use of the temperature sensor, which is generally connected to the control apparatus of the washing machine, allows the evaporation capacity to be controlled.

If present, the heating element is preferably arranged in the water container. However such a heating element can also be positioned in a further container filled with water so that the production of mist and steam is performed in two separate containers. The shared arrangement of heating element and ultrasonic nebulizer in the water container however advantageously allows the production of an aerosol/steam mixture at a desired temperature. A temperature sensor is advantageously arranged in the water container for this purpose. The temperature sensor can preferably supply measured values for the temperature in the water container to the control apparatus of the washing machine, allowing the control apparatus to control heating element and ultrasonic nebulizer in such a manner that a desired temperature of the aerosol/steam mixture is reached.

In one particularly preferred embodiment of the inventive washing machine therefore the control apparatus is set up in such a manner that it allows the setting of a desired drop size, quantity and/or temperature of an aerosol or a steam/aerosol mixture in the water container.

An adequate water level in the water container is important for the ultrasonic nebulizer to function. Therefore at least one water level sensor is preferably arranged in the water container and/or in an additional container for the production of steam. This allows the correct operation of the ultrasonic nebulizer to be monitored. A number of water level sensors are preferably positioned so that particularly accurate information about the water level can be forwarded to the control apparatus.

It is particularly preferable for the control apparatus to be embodied in such a manner that it can initiate the supply of water to the water container if the water level is too low, for example by opening a valve to the water supply system of the washing machine until a certain water level is reached.

The water container used in the inventive washing machine is generally relatively flat compared with its height so that aerosol and in some embodiments of the invention also steam can be produced efficiently without the water level dropping too significantly.

A relationship between on the one hand average drop size and quantity of the aerosol, duration of a treatment using the aerosol and on the other hand nature and quantity of soiling and/or nature and where applicable quantity of soiled laundry items is preferably stored in the washing machine.

According to the invention it is particularly advantageous if the water container and drum together with a mist channel and a mist return channel form a circuit in the washing machine. It is also preferable here for the circuit to pass through a sleeve of the washing machine.

According to the invention the quantity, drop size and drop size distribution as well as the temperature of the steam/aerosol mixture can also preferably be set specifically when producing a steam/aerosol mixture. It is also possible to introduce different additives for the treatment, such as fragrances by means of the steam/aerosol mixture. According to the invention this is achieved particularly effectively in that a desired additive is added to the water in the water container.

A washing machine generally also has a wash liquor drain system arranged on the base of the outer tub with a drain pump and generally also laundry agitators and/or scoop devices. A pressure sensor and/or a temperature sensor is/are also generally arranged in the outer tub in a washing machine. Pressure and temperature sensor, if present, are preferably arranged in a lower region of the outer tub so that pressure and/or temperature of an aqueous liquid present in the outer tub can be measured.

In one preferred embodiment the washing machine has a water supply system, which is split into a water supply line for the water container and an outer tub supply line. A 3/2 valve (switching valve, unpressurized) for example can be used for this purpose. In the case of an outer tub supply line a detergent tray and a connecting pipe to the outer tub, for example a filler hose for wash liquor/water, is generally connected to the outer tub supply line.

The control apparatus in the washing machine is preferably set up in such a manner that it allows the setting of a desired drop size, quantity and/or temperature of an aerosol or in some embodiments of a steam/aerosol mixture in the water container. A relationship between on the one hand drop size, quantity and/or temperature of the steam/aerosol mixture and on the other hand the nature and scope of impurities and/or the nature and where applicable quantity of the contaminated objects is preferably stored in the control apparatus here.

The washing machine can advantageously have a display device relating to the performance of an inventive method, it being possible for the performance of the method per se and/or the correct operation of the ultrasonic nebulizer for example to be displayed. The display device can be an optical and/or acoustic display device.

The control apparatus is preferably set up in such a manner that it is possible to regulate not only the control of a treatment program but also the production of an aerosol and in some embodiments of the invention steam production. If ultrasonic nebulizer and where applicable steam producer are not operating correctly, the control apparatus can preferably institute remedial measures. Thus the control apparatus can switch off the steam producer, the ultrasonic nebulizer and, if present, the heating elements and/or bring about a corresponding acoustic and/or optical display on a display device if for example the water level is too low or in some embodiments of the invention if the temperature of the steam or the steam/aerosol mixture is too high.

The invention also relates to a method for treating laundry items in a washing machine having a drum for accommodating laundry items to be treated, which is supported in a rotatable manner in an outer tub, comprising a water supply system, a control apparatus, a water container and a water drop producer, the water drop producer having an ultrasonic nebulizer, which is arranged in the water container, comprising the following steps:

(a) placing laundry items in the drum;

(b) producing an aerosol in the water container by means of the ultrasonic nebulizer;

(c) directing the aerosol into the drum; and (d) treating the laundry items using the aerosol.

The inventive method allows gentle wetting of the laundry items in the washing machine using mist, it being possible only to moisten the surfaces and dirt without saturating the interior of the laundry items and textile fibers completely in the process. A water mist with a drop size in the region of 0.2 to 10μ, preferably in the region of 1 to 5μ is preferably used. However the drop size can be tailored to the nature and quantity of laundry items within a wide range.

Without being bound by the following explanation, it is assumed here that the fine water drops of the aerosol can be deposited on the surface of the laundry items to loosen regions of dirt as a result of their surface tension in particular on hydrophobic surfaces and can migrate down, for example in the case of dried-on mud or large areas of soiling containing protein. Or the aerosol can help to detach such dirt mechanically in the case of hydrophobic soiling on hydrophilic surfaces, e.g. grease on cotton.

With the inventive method deeper penetration of the dirt into deeper textile fiber layers and in the case of multilayered textiles, e.g. from the top material into the filler material, is clearly avoided by the formation of a boundary layer with water between the laundry item and the dirt. An unnecessarily large amount of mechanical washing action, energy, water, washing agent or time would otherwise be required to loosen such dirt that has migrated into the interior again.

An inventive method is therefore preferred in which the aerosol or in some embodiments of the invention a steam/aerosol mixture is brought into contact with the laundry items before a washing phase to loosen and/or detach dirt.

In one particularly preferred embodiment of the invention the laundry items are therefore essentially dry before treatment using the aerosol according to step (d). For example dry laundry items can be introduced into the drum and then treated for a predetermined time period using the mist or aerosol. This time period and/or the quantity of mist used is/are preferably set in respect of the nature and quantity of the laundry items introduced and the determined soiling. This setting can be brought about automatically or by a user of the washing machine as a function of sensors present.

The use of the fine water drops of the aerosol in any case allows the loosening or detaching of dirt. This cleaning process can be further promoted by a suitable movement program of the drum so that it is ensured for example that all the laundry items come into contact with the aerosol and/or loosened dirt can be detached mechanically from the surface of the laundry items.

In one preferred embodiment of the inventive method dry laundry items made of wool are also treated in the drum in the mist with a comparatively significant mechanical action as there is no or only little risk of the wool shrinking. The loosened dirt can then be removed from the surface of the laundry items using water with very little movement as part of the washing process. The actual washing process can also be assisted with mist at least also in the reversing pauses, in other words phases in which the drum stands still, in the case of wool for example.

The invention also allows in particular a very efficient use of washing aids such as detergents, as these can assist the action of the aerosol. In one particularly preferred embodiment of the invention therefore additives such as washing aids are added to the water in the water container and said washing aids are directed into the drum together with the aerosol so that the treatment of the laundry items takes place in the presence of the washing aid.

It can in turn be advantageous here that an aerosol/steam mixture is produced from the aerosol and a thermally formed water vapor, the aerosol/steam mixture is directed into the drum and the laundry items are treated using the aerosol/steam mixture. It is particularly preferable that a temperature of the steam/aerosol mixture is controlled in such a manner that a maximum temperature value $T_{max}$ of the steam/aerosol mixture that is stored in the control apparatus for a type of textile introduced and/or a type of soiling is not exceeded.

The heating element used in the water container in some embodiments of the invention does not have to be used to produce steam. In one advantageous embodiment of the inventive method the water in the water container is heated in the presence of a heating element by this means initially for hygiene reasons to a comparatively high temperature, for example 60° C., and then a desired aerosol is produced using the ultrasonic nebulizer.

It is also preferable in the inventive method for the steam/aerosol mixture to be brought into contact with objects to be cleaned before a wash phase using an aqueous liquid to loosen dirt.

In one preferred embodiment of the method the aerosol is directed from the water container by way of a mist channel, in which a fan is arranged, into the drum and passes back again by way of a mist return channel into the water container. The aerosol particularly preferably reaches the drum by way of a sleeve of the washing machine and passes back again into the water container by way of a mist return channel ending in a rear wall of the drum.

As well as loosening and detaching dirt, the inventive washing machine offers further options. Thus in an inventive method to be performed in said washing machine the laundry items can be provided with certain additives such as fragrances and softeners for example to give them certain properties.

In some embodiments of the invention, in which an aerosol/steam mixture is used, the temperature of a steam/aerosol mixture can be regulated so that it is appropriate for every type of textile and soiling in a simple manner without textile damage occurring. The invention here also allows for example soiling containing protein, e.g. blood and food residues, to be loosened beforehand without the risk of being burned in that exists for example with hot steam.

Crease removal can take place as a separate program at different temperatures (cold to 90° C.) depending on the type of textile.

Similarly a refreshing treatment could take place as a separate program at different temperatures from cold to 60° C.

In some embodiments of the invention a hygiene treatment is possible at higher temperatures (e.g. 60 to 100° C.). For example a hygiene treatment can take place in a washing machine during the final spin, when there is good visibility and a large surface. A steam/aerosol mixture is advantageously directed onto a ring of laundry that is flattened out at high rotation speeds here.

Also according to the invention comparatively little energy is used to produce an aerosol or an aerosol/steam mixture, so there is a high level of energy efficiency. The configuration of larger drops and therefore wetting of the laundry items and the transportation of dirt into the interior of laundry items or into the fibers contained therein can be avoided.

The invention has numerous advantages. It is possible in a simple and very efficient manner to use mist, in other words an aerosol, where applicable in combination with steam, to treat laundry items. This is particularly advantageous in order to loosen and detach dirt but also to eliminate creases, etc. In some embodiments of the invention it is also possible to improve hygiene during a rinse and spin cycle, when it is possible to set desired temperatures easily.

The invention allows timely loosening of dirt on the surface of laundry items, gentle and efficient treatment of delicate materials or laundry items made of these (wool, silk). In particular it is possible to loosen and detach surface dirt, it being possible to dispense with protection against the penetration of the dirt into the laundry item and in particular into deeper fiber layers. For the treatment of delicate laundry items, such as those made of wool and silk, which might shrink or be damaged if completely saturated with mechanical movement, a particularly gentle treatment is therefore possible.

Finally the invention allows laundry to be prepared in a staged washing process in which a treatment with wash liquor can take place for example before or after the treatment using aerosol. It is a major advantage of the present invention that water consumption can be significantly reduced.

The washing machine of the invention allows the performance of a treatment method to be tailored to the degree of soiling of the objects, e.g. laundry items, to be cleaned.

Figure 2:
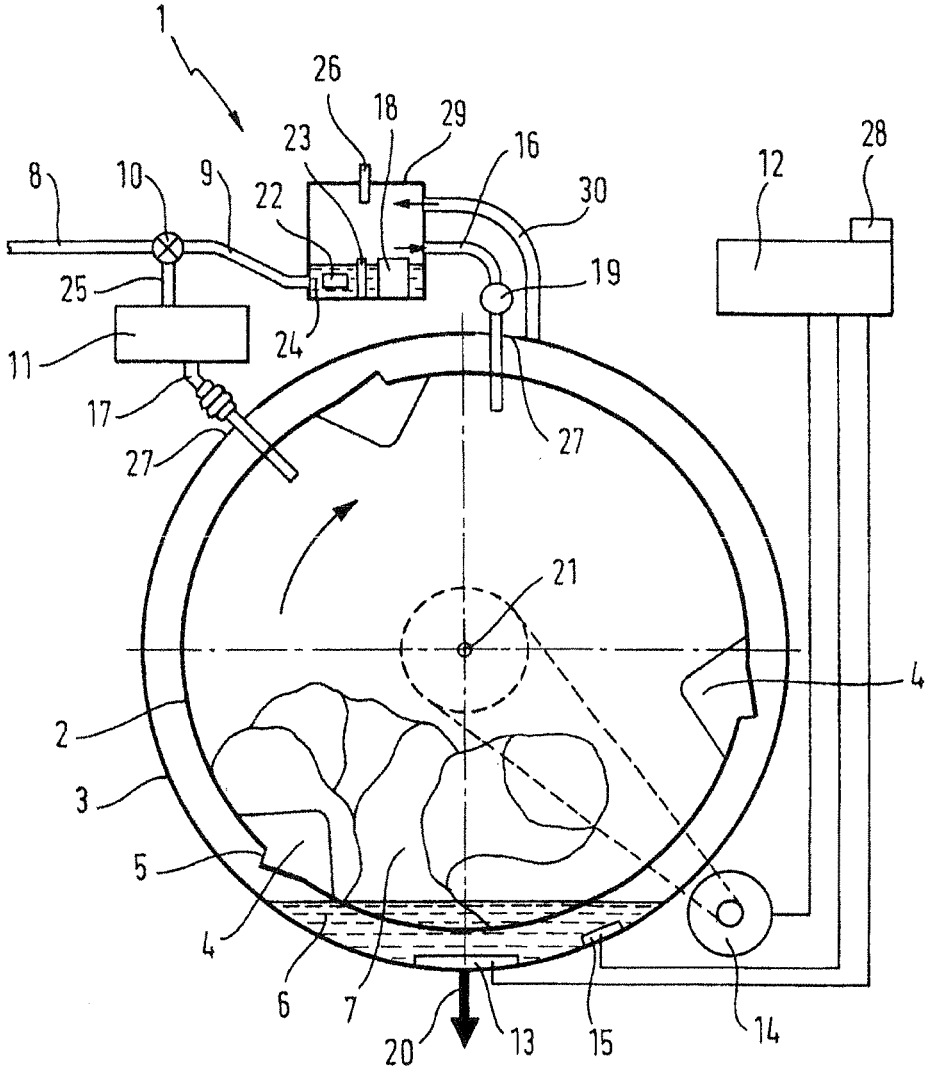

Exemplary embodiments of the invention are described in more detail below with reference to FIGS. 1 and 2 of the accompanying drawing, in which:

FIG. 1 shows a schematic diagram of the parts of a first embodiment of a washing machine that are of relevance here, said first embodiment not being intended to be restrictive, FIG. 2 shows a schematic diagram of the parts of a second embodiment of a washing machine that are of relevance here, said second embodiment not being intended to be restrictive.

The washing machine 1 shown in FIG. 1 has an outer tub 3, in which a drum 2, in which laundry items 7 to be treated are present, is supported in such a manner that it can be rotated about a rotation axis 21 and can be operated by a drive motor 14. The long arrow here shows the rotation direction of the drum. Laundry agitators 4 and scoop devices 5 for a wash liquor 6 are present on the inner surface of the drum casing in the drum 2.

In the first embodiment of a washing machine shown in FIG. 1 water from the water connector 8 passes from the household water system first to an electrically controlled three-way valve 10, from which faucet water can be conveyed to two different points.

On the one hand faucet water can pass from the three-way valve 10 by way of a water supply line 9 to a water container 29, in which an ultrasonic nebulizer 18 and a water level sensor 23 are arranged in the water 24. From the water container 29 a mist channel 16, in which a fan 19 is arranged, passes by way of a sleeve 27 into the interior of the drum 2. This allows mist produced by the ultrasonic nebulizer 18 (also referred to as aerosol here), generally a cold water mist with an average drop size in the region of 1 to 10 μm, to reach the drum 2 and therefore the laundry items 7 to be treated. This mist for example brings about a loosening and detaching of dirt on the laundry items 7. This effect can be assisted by suitable rotation of the drum 2. Different rotation speeds and directions can be set here as a function of the nature and quantity of the laundry items 7 and of the soiling. Relationships between the nature and quantity of the laundry items and of the soiling and different rotation speeds and directions are preferably stored in the control apparatus 12 of the washing machine 1 here so that certain rotation programs including predetermined reversing rhythms are predetermined for certain situations. A mist return channel 30 passes from the drum, for example from a point (not shown in detail here) in a rear wall, back to the water container 29. This allows the mist produced to be conducted in the circuit through the drum 2 with the aid of the fan 19.

The voltage required to activate the ultrasonic nebulizer 18 is directed by way of a line (not shown here) to the ultrasonic nebulizer 18, it being possible for the line to be connected to an accumulator, a battery or the like.

On the other hand faucet water can be directed from the three-way valve 10 by way of a detergent tray supply line 25 to a detergent tray 11. The detergent tray 11 is connected by way of a connecting pipe (filler hose) 17 to the outer tub 3 or the drum 2. The water arriving by way of the water connector 8 or the detergent tray supply line 25 can transport portions of washing agent present there by way of the detergent tray 11 into the outer tub 3 by way of the connecting pipe 17.

A wash liquor drain system 20, which according to conventional practice has a drain valve and a drain pump in addition to corresponding lines, is only shown schematically for the sake of clarity.

To display acoustically and/or optically that the ultrasonic nebulizer 18 is not operating correctly, there is an optical display device 28 present on the washing machine 1 of the first embodiment shown here.

A wash liquor heater 13 is also present in the outer tub 3. Embodiments without a wash liquor heater are however conceivable. The three-way valve 10 and the wash liquor heater 13 can be controlled by a control apparatus 12 as a function of a sequence, which can be linked to a time program and/or the reaching of certain measured values of parameters such as wash liquor level, wash liquor temperature, rotation speed of drum, etc. within the washing machine.

In FIG. 1 15 indicates a pressure sensor for measuring the hydrostatic pressure p in the outer tub 3, which results from the fill level of the free liquor forming in the outer tub 3 when treatment steps with an aqueous liquid are also performed in the washing machine 1. The signals from drive motor 14, pressure sensor 15, etc. are supplied to the control apparatus 12, even though this is not shown for reasons of clarity.

A method for treating laundry items as will be described in more detail below can advantageously be performed in said washing machine. Essentially dry or dry laundry items 7 are first placed in the drum 2 and an aerosol with an average particle size in the region of 1 to 10 μm is then produced in the water container 29 and directed by way of the mist channel 16 into the drum 2. The drum 2 is moved at the same time or at least with some overlap so that the aerosol comes into contact with all the laundry items 7 and dirt can be loosened and detached in a mechanical manner.

In the first embodiment shown in FIG. 1 the aerosol is directed from the water container 29 by way of a mist channel 16, in which a fan 19 is arranged, into the drum 2 and passes back again into the water container 29 by way of a mist return channel 30, this process being repeated until a predetermined period for aerosol treatment has elapsed.

A washing aid in the form of a detergent is added to the water 24 in the water container 29 in a manner not shown here. This detergent can then be absorbed into the mist and the fine mixture of washing agent and water produced can be conveyed into the drum 2 for an improved cleaning action.

These steps preferably take place before the start of a wash program to loosen dirt. A movement program can already be performed as mentioned above. In one embodiment of the method additional water is then introduced into the drum by way of the detergent tray, with washing aids placed in the detergent tray also generally being flushed into the drum.

Alternatively or additionally the mist or the aerosol contained therein can also be used after the end of a wash program including a rinse segment to counteract creasing or to provide the laundry items with other desired properties.

FIG. 2 is a schematic diagram of the parts of a second embodiment of a washing machine that are of relevance here, said second embodiment not being intended to be restrictive.

The second embodiment differs from the first embodiment essentially in the arrangement of the water container 29 and the fact that in addition to an ultrasonic nebulizer 18 a heating element 22 is also present in the water container 29 to produce steam from the water 24. Therefore in the second embodiment an aerosol/steam mixture can be produced. The temperature of this mixture can also be set in that a temperature sensor 26 and the control apparatus 12 are used to control the heating element 22 and the ultrasonic nebulizer 18 so that a suitable aerosol/steam mixture is produced at a predetermined temperature. If the meaning of certain reference characters is not examined specifically below, they have the same meaning as for the first embodiment in FIG. 1.

In the second embodiment shown in FIG. 2 therefore water flows in the water supply line 9 to a water container 29, in which a heating element 22 for producing steam, an ultrasonic nebulizer 18, a temperature sensor 26 and a water level sensor 23 are positioned. The water level sensor 23 serves to monitor the water level and to initiate a supply of water subject to the influence of the three-way valve 10, as a certain water level must be maintained for the operation of heating element 22 and ultrasonic nebulizer 18.

From the water container 29 a mist channel 16, in which a fan 19 is arranged, passes by way of a sleeve 27 into the interior of the drum 2. In the second embodiment shown here however an aerosol/steam mixture is conveyed into the drum 2 in the mist channel 16. This allows cold mist produced by the ultrasonic nebulizer 18 to be mixed with steam so that an aerosol/steam mixture at a certain temperature is formed, which is tailored to the requirements of a laundry load (nature and quantity of laundry items and of soiling). The aerosol/steam mixture passes into the drum 2 and therefore onto the laundry items 7 to be treated. Dirt on the laundry items 7 is loosened and detached due to the action of the aerosol/steam mixture. This effect can be assisted by a suitable rotation program of the drum 2, as described in detail above for the first embodiment. In particular different rotation speeds and directions can be set as a function of the nature and quantity of the laundry items and of the soiling. To this end relationships between on the one hand the nature and quantity of the laundry items and of the soiling and on the other hand different rotation speeds and directions as well as properties of the aerosol/steam mixtures (in particular the particle size in the aerosol and the temperature of the mixture) are stored in the control apparatus 12 of the washing machine 1 so that certain rotation programs including predetermined reversing rhythms are predetermined for certain situations.

These steps are preferably performed to loosen and detach dirt before the start of a wash program in which an aqueous liquid is used, as described above for the first embodiment.

A mist return line 30 passes back to the water container 29 from the drum, for example from a point (not shown in detail here) in a rear wall. This allows the aerosol/steam mixture produced to be conducted in the circuit through the drum with the aid of the fan 19.

The voltage required to activate the ultrasonic nebulizer 18 is directed by way of a line (not shown here) to the ultrasonic nebulizer 18, it being possible for the line to be connected to an accumulator, a battery or the like.

In the second embodiment of a washing machine shown in FIG. 2 a method can therefore be performed, in which an aerosol/steam mixture is also produced from the aerosol and a thermally formed water vapor, the aerosol/steam mixture is directed into the drum 2 and the laundry items 7 are treated with the aerosol/steam mixture.

LIST OF REFERENCE CHARACTERS

1 Washing machine
2 Drum
3 Outer tub
4 Laundry agitator
5 Scoop device
6 Wash liquor
7 Laundry items
8 Water connector (from household water system)
9 Water supply line for ultrasonic nebulizer
10 Electrically controlled three-way valve
11 Washing agent dispenser (detergent tray)
12 Control apparatus
13 Wash liquor heater
14 Drive motor
15 Pressure sensor
16 Mist channel (channel for conveying aerosol or aerosol/steam mixture)
17 Connecting pipe (filler hose for wash liquor/water)
18 Ultrasonic nebulizer
19 Fan for conveying aerosol or aerosol/steam mixture
20 Wash liquor drain system
21 Rotation axis (of drum)
22 Heating element for producing steam
23 Water level sensor
24 Water
25 Detergent tray supply line
26 Temperature sensor
27 Sleeve
28 Display device, optical and/or acoustic

29 Water container
30 Mist return line

The invention claimed is:

1. A washing machine having a drum for accommodating laundry items to be treated, which is supported in a rotatable manner in an outer tub, comprising a water supply system, a control apparatus, a water container and a water drop producer, characterized in that the water drop producer has an ultrasonic nebulizer, which is arranged in the water container, the water container and drum together with a mist channel and a mist return channel forming a circuit, wherein the mist return channel has an outlet end configured to direct mist back to the water container, where the nebulizer is arranged, and through the mist channel for recirculation into the drum.

2. The washing machine as claimed in claim 1, wherein the ultrasonic nebulizer is connected to the drum by way of the mist channel, in which a fan is present to convey mist produced in the ultrasonic nebulizer.

3. The washing machine as claimed in claim 1, wherein the washing machine has a heating element to produce steam.

4. The washing machine as claimed in claim 3, wherein the heating element is arranged in the water container.

5. The washing machine as claimed in claim 4, wherein a temperature sensor is arranged in the water container.

6. The washing machine as claimed in claim 1, wherein at least one water level sensor is arranged in the water container.

7. The washing machine as claimed in claim 1, wherein the control apparatus is set up in such a manner that it allows the setting of a desired drop size, quantity and/or temperature of an aerosol or a steam/aerosol mixture in the water container, a relationship between either average drop size and quantity of the aerosol, duration of a treatment using the aerosol or nature and quantity of soiling and/or nature and where applicable quantity of soiled laundry items being stored in the control apparatus.

8. The washing machine as claimed in claim 1, wherein the circuit passes through a sleeve of the washing machine.

9. A method for treating laundry items in a washing machine having a drum for accommodating laundry items to be treated, which is supported in a rotatable manner in an outer tub, comprising a water supply system, a control apparatus, a water container and a water drop producer, the water drop producer having an ultrasonic nebulizer, which is arranged in the water container, comprising the following steps:

(a) placing laundry items in the drum;
(b) producing an aerosol in the water container by means of the ultrasonic nebulizer;
(c) directing the aerosol into the drum; and
(d) treating the laundry items using the aerosol, the aerosol being directed from the water container by way of a mist channel, in which a fan is arranged, into the drum and passing back again into the water container, where the nebulizer is located and where the aerosol is produced, by way of a mist return channel.

10. The method as claimed in claim 9, wherein the laundry items are essentially dry before treatment using the aerosol.

11. The method as claimed in claim 9, wherein washing aids are added to the water in the water container and said washing aids are directed into the drum together with the aerosol so that the treatment of the laundry items takes place in the presence of the washing aid.

12. The method as claimed in claim 9, wherein an aerosol/steam mixture is produced from the aerosol and a thermally formed water vapor, the aerosol/steam mixture is directed into the drum and the laundry items are treated using the aerosol/steam mixture.

* * * * *